United States Patent [19]

Hawkins

[11] Patent Number: 4,497,116

[45] Date of Patent: Feb. 5, 1985

[54] COMPOUND LEVER BOW SIGHT

[76] Inventor: Brian Hawkins, 59 N. Paquatuch Ave., E. Moriches, N.Y. 11940

[21] Appl. No.: 483,816

[22] Filed: Apr. 11, 1983

[51] Int. Cl.[3] ..... F41G 1/00

[52] U.S. Cl. ..... 33/265; 124/23 R

[58] Field of Search ..... 33/265, 261, 276; 124/23 R, 23 A, 24 R, 24 A, 25, 86, 87

[56] References Cited

U.S. PATENT DOCUMENTS 2,542,501 2/1951 Fredrickson ..... 33/265

3,487,548 1/1970 Frydenlund ..... 33/265

*Primary Examiner*—Charles Frankfort

*Assistant Examiner*—Patrick Scanlon

*Attorney, Agent, or Firm*—Kevin Redmond

[57] ABSTRACT

An improved archery bow sight comprising a frame, a forward and a rear sighting element movably mounted to the frame and a mechanism for simultaneously positioning the sighting elements along any one of a plurality of sighting lines originating at the operator's eye to enable the operator to maintain his sighting eye at one position while aiming the bow at any one of a plurality of ranges. The sight further comprises a range indicator and a range adjustment trigger that may be actuated by the operator while the bow is drawn.

11 Claims, 5 Drawing Figures

COMPOUND LEVER BOW SIGHT

BACKGROUND AND FIELD

This invention relates to sights for small arms and is particularly adapted to sights for archery bows.

Archery bows have developed from the simple bow and string to modern compound bows in which maximum force is not reached until after release of the arrow. This feature is made possible by a pulley arrangement as shown in FIG. 1. The advantage of this type of bow is improved accuracy obtained because the operator may release the arrow at a point where he is not required to maintain maximum pull on the string.

Unfortunately, bow sights have not kept pace with such advances in archery bows. Sights on bows are necessary because the drop in the arrow over relatively short distances is appreciable and must be accounted for in aiming the bow. The elevation angle at which an arrow is to be released must be progressively increased as the target distance is increased.

In simple archery bows no sights are provided. These bows rely on the operator's eye and judgement to aim the bow and set the proper elevation angle. Some relatively simple sights have been added recently to the compound bows. They generally are comprised of a series of pins which may be used as guides in directing the arrows.

One prior art embodiment includes only a single element sight which greatly decreases the accuracy that can be achieved. A second prior art embodiment includes a dual sight, but both elements are fixed with respect to one another and therefore the operator must move his eye in order to use the sight, offsetting his normal anchor point.

SUMMARY

It is an object of the present invention to provide an archery bow sight which enables the operator to maintain his preferred eye position in relation to his normal anchor point regardless of the desired elevation angle.

It is an object of the present invention to provide a bow sight which contains two movable sighting elements.

It is an object of the present invention to provide a bow sight with two sighting elements which are moved simultaneously and aligned to a plurality of sight lines emanating from the operator's preferred eye position.

It is an object of the present invention to provide a means for quickly and easily setting the sight range while operating the bow.

It is an object of the present invention to provide a means for reading the range set into the bow sight.

The present invention is an archery bow sight comprising a frame, forward and rear sighting elements movably mounted to the frame and a mechanism for simultaneously positioning the sighting element along any one of a plurality of sighting lines originating at the operator's eye to enable the operator to maintain his sighting eye at one position while aiming the bow at any one of a plurality of ranges.

The forward and rear sighting elements are connected to individual lever arms. The lever arms of the forward sighting element is pivoted at a point which provides a greater mechanical advantage than the rear sighting element lever arm, enabling the forward sighting element to move a greater distance when both levers are driven from a common drive mechanism. This arrangement permits the forward and rear sighting elements to remain aligned along any one of a plurality of sighting lines emanating from the operator's eye.

The sighting elements are designed to facilitate acquiring and aiming at the target. The forward sighting element is formed of a horizontal pin which is narrowed in its center to avoid blocking the view of the target. The rear sighting element is formed of an aperture ring which provides the operator with a wide field of view.

A trigger linked to the drive mechanism moves the drive mechanism and sighting elements, allowing the operator to choose the range while actuating the bow. The range to which the sight is set is indicated by a calibrated range gage which is attached to the drive mechanism and thereby directly reflects the elevation angle and sight line set by the position of the forward and rear sighting elements.

DETAILED DESCRIPTION OF THE INVENTION

Figure 1A:
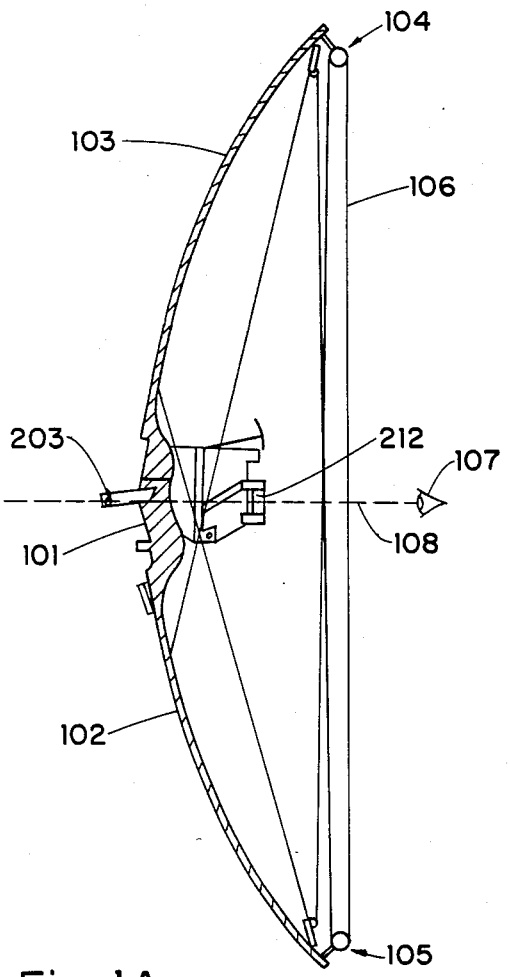
FIG. 1A is a diagram of a compound bow showing the location of the operator's eye and the position of the present invention when affixed to the central portion of the bow.

The bow in FIG. 1A comprises a bow stock or central portion 101, a lower bow arm 102, an upper bow arm 103, an upper pulley assembly 104, a lower pulley assembly 105, a bow string 106, an operator's eye 107, a line of sight emanating from the operator's eye 108 and passing through a forward sighting element 203 and a rear sighting element 212.

The upper and lower bow arms are connected at one end to the central portion and support at their opposite ends the pulley assemblies 104 and 105 respectively. The bow string is passed about the pulley assemblies and secured to the bow arms on either side of the central portion. The pulley arrangement is designed to cause the bow to reach maximum pull when the bow string is withdrawn midway. The pressure on the bow string is reduced as the operator continues to pull the string back to the normal release position. This enables the operator to release the arrow with less difficulty and therefore greater accuracy may be obtained. The operator aims the bow by sighting along a sight line which passes through the center of the rear and forward sighting elements 212 and 203. In the present invention, the rear sighting element is a ring which provides a wide field of view, while the forward sighting element is a pin which is sufficiently small to avoid obscuring the target, the two elements combining to facilitate locating and maintaining the target in the sight. These features overcome major disadvantages of prior art sights, such as peep hole sights.

Figure 1B:
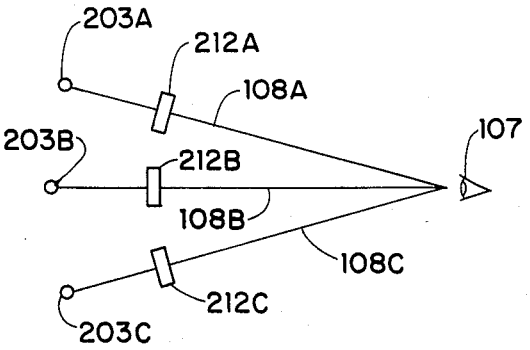
FIG. 1B is a diagrammatical view showing the operator's eye and various positions of the sighting elements.

FIG. 1B shows the operator's sight lines 108A, 108B and 108C for three representative positions for the forward and rear sighting elements designated by drawing numerals 212A through 212C and 203A through 203C, respectively.

The forward and rear sighting elements are constrained to move simultaneously to positions which align them along a plurality of sighting lines, such as representative lines 108A through 108C. Note that the sighting eye may remain fixed at a desired position while the sighting element are constrained to move along the sighting lines which emanate from the desired position of the eye. This feature enables the operator to maintain his eye at a preferred position regardless of the elevation angle to which the sight is set.

Figure 2:
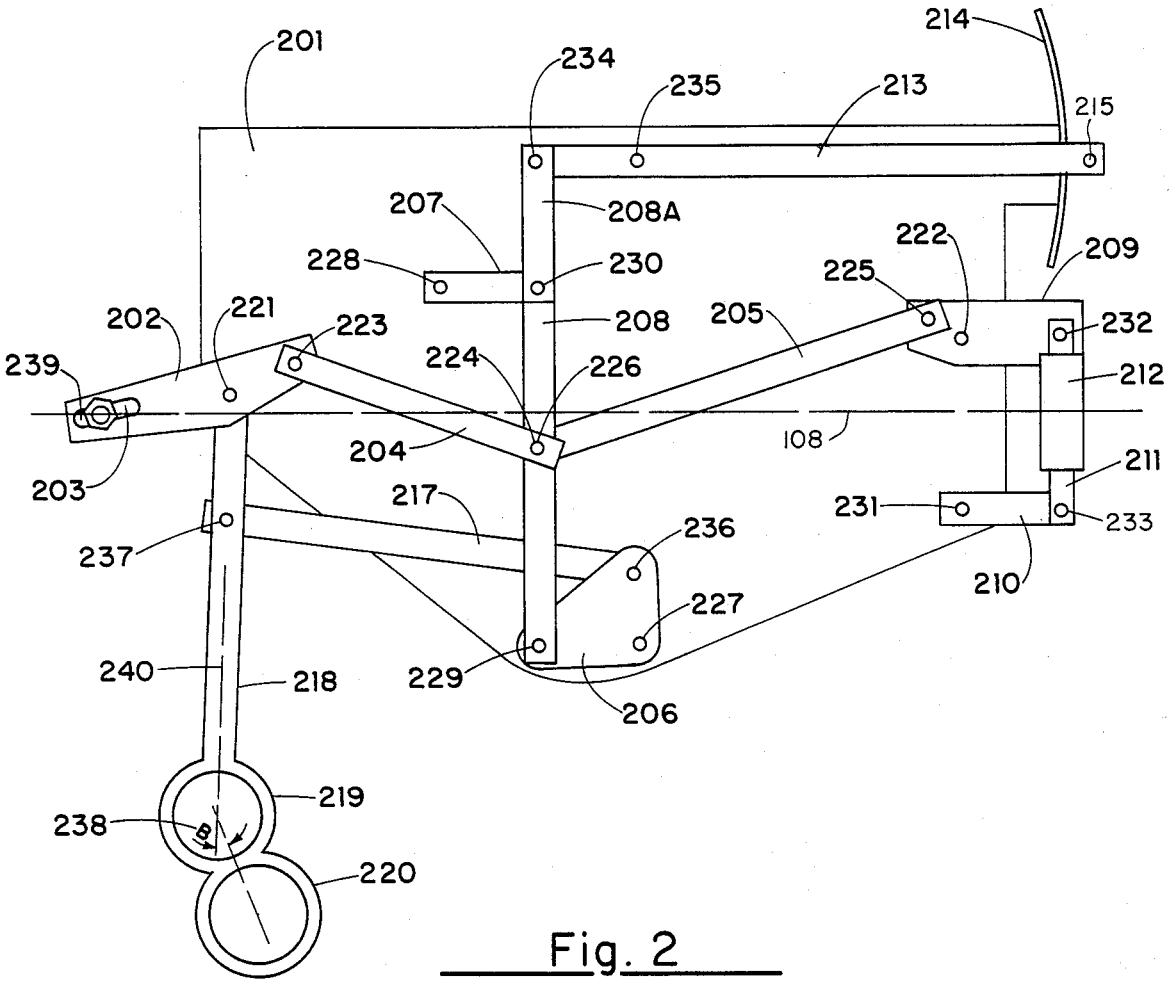
FIG. 2 is a side elevation view of the present invention, illustrating the drive mechanism.

Slot mounting hole 239 is provided in the forward sight crank 202 (shown in FIG. 2) to increase or decrease the mechanical advantage to the drive of the forward sighting element in order to provide the correct sighting line required for different arrows. FIG. 2, which shows the principal elements of the drive mechanism, is described in detail below; however, it is pertinent at this point to note that there is a need for different mechanical advantages in the drive of the forward and rear sights for different arrow lengths. The ability to make this adjustment is particularly useful when switching from one length of arrows to another, as from 29" arrows to 31" arrows. In this case, sight line 203A through 203C will be at greater angles for a 29" arrow than a 31" arrow.

FIG. 2 is a detailed drawing, illustrating the sight components, their interconnection and especially the movement of these components as used in setting the position of the sighting elements 203 and 212. The components include a frame 201, a forward sight crank 202, a forward sight pin 203 (the forward sighting element), a froward compound lever 204, a rearward compound lever 205, a lower idler arm bell crank 206, an upper idler arm 207, a vertical compensating link 208, a range pointer arm link 208A, a rear aperture crank 209, an aperture idler 210, an aperture mounting arm 211, a rear aperture sight 212 (the rear sighting element), a range pointer 215, a range pointer arm 213, a range scale 214, a range adjustment arm 217, a range adjustment trigger 218, and range adjustment rings 219 and 220.

For reference purposes, the frame 201 and virtually all of the lever-like components shown in FIG. 2 may be considered as being positioned in a single vertical reference plane. The vertical reference plane is considered as generally including the bow and arrow where the bow is positioned generally vertically and the arrow is in its normal position for shooting across the bow and oriented along a horizontal axis. Although some components are actually positioned in planes which are parallel to and immediately adjacent to the reference plane, the vertical reference plane is considered to have a thickness which includes these planes to simplify the description of the device. The direction of the arrow is considered as forward while the opposite direction is considered as rearward. Components which are labeled forward, are located forward (or to the left as shown in FIG. 2) of the vertical compensating link 208, while those labeled rear are to the rear (or to the right as shown in FIG. 2) of the vertical compensating link 208.

The forward sighting pin is positioned horizontally and generally orthogonal to the vertical reference plane and is connected to the forward end of the forward sight crank which comprises a first lever arm. The first lever arm is pivoted about pivot 221 with respect to the frame 201. Pivot 221 is similar to a series of pivots used to mount and connect the many lever-like components of the sight. These pivots are typically formed of rivets or screws passed through the levers and, in some cases, the frame. Their bearing surfaces are smooth to facilitate rotational movement of the components they connect. The pivots also transmit translational motion from one lever to another depending on the direction of the motion applied.

The rear sighting element 212 is connected to a rear sighting element crank 209 by pivot 232. The rear sighting element crank in turn is connected to the frame by pivot 222.

A principal feature of the invention lies in the design of the first and second lever arms. That is, when the same drive is applied to the first and second lever arm, the forward sighting element will be driven over a greater distance than the rear sighting element 209 to maintain the two aligned on any one of a plurality of sight lines emanating from the operator's eye. This is accomplished by making the value of the distance from the forward sighting element to pivot 221 divided by the distance from pivot 221 to the opposite end of the first lever arm, greater than the distance from the connection of the rear sighting element to pivot 222 divided by the distance from the pivot 232 to pivot 222.

The remaining component serves to provide the drive for these two lever arms and to indicate the amount of drive as range of a scale which can be conveniently read by the operator. The principal drive component is the vertical compensating link 208 which is oriented generally vertically and positioned in the central area of the sight.

The first lever arm is connected to the vertical compensating link by way of the forward compound lever 204 and pivots 223 and 224 which are located at each end of the forward compound lever. Similarly, the second lever arm is connected to the vertical compensating link by way of rear compound lever 205 and pivots 226 and 225 which are located at the ends of the rear compound lever. The compound levers may be secured to the vertical compensating link at different points, but in order to facilitate fabrication they are usually connected at the same point, colocating pivots 224 and 226 so that only a single pivot need be utilized.

The vertical compensating link is maintained in its vertical position by the upper idler arm and lower idler bell crank which are positioned orthogonal to the vertical compensating link, with one above the other and one on either side of the link. The ends of the upper idler arm and lower idler bell crank that extends away from the vertical compensating link are connected to the frame by means of pivots 228 and 227 respectively, while the opposite ends of the upper idler arm and lower idler bell crank are connected to the vertical compensating link by pivots 230 and 229 respectively.

The rear sighting element 212 is an annular ring which is connected to the second lever (rear sighting element crank 209) by way of the rear sight mounting arm. The rear sight mounting arm 211 is connected at one end to the second lever 209 and at the other end to the rear sighting element idler 210 by means of pivots 232 and 233, respectively. The opposite end of the rear sighting ider arm is connected to the frame by pivot 231. The rear sighting element idler arm is the same length as the second lever arm 209 and generally positioned parallel and below the second lever arm. By way of this arrangement, the rear sighting element mounting arm 211 and the rear sighting element 212 are maintained generally vertically throughout their range of movement.

A desired range is set into the sight by means of the range adjustment arm and range adjustment trigger. The range adjustment arm 217 is a lever arm which at one end is connected to and extends generally forward of the lower idler bell crank 206. Connections is made by means of pivot 236. The opposite end of the range adjustment arm is connected to the range adjustment trigger 218 by means of pivot 237. The top of the range adjustment trigger shares a common pivot 221 and may be actuated by the operator and moved to set the desired range. This movement is transmitted through the range adjustment arm, lower idler bell crank, and vertical compensating link to the first and second lever arms which set the position of the forward and rear sighting elements.

The range adjustment rings 219 and 220 are attached to the lower end of the trigger 218 to permit both forward as well as rearward motion of the trigger by any finger which can then be moved back to position on the hand grip of the bow prior to shooting. The range adjustment ring 219 is directly connected to the lower end of the trigger 218. A center line 240 through the trigger bisects the ring 219. The ring 220, however, is not as symmetrically located. It is connected at one edge to the ring 219, but offset from the center line 240 by an angle B 238 which positions the ring 220 slightly to the rear of ring 219, providing the operator with a second conveniently located ring with which to grip and move the trigger.

An indication of range is provided by the range pointer 215, range pointer arm 213, range pointer arm link 208A and range scale 214. The range pointer arm is a lever arm which is positioned generally horizontally and extends rearward of the range pointer arm link to which the range pointer arm is connected at one of its ends by way of pivot 234, range pointer arm link 208A and pivot 230. The range pointer arm link 208A extends generally vertically above and is moved generally vertically by the vertical compensating link. The end of the range pointer arm away from the vertical compensating link is rigidly connected to the range pointer 215, which is positioned horizontally in a plane orthogonal to the vertical reference plane. Between its two ends, the range pointer arm is rotatably connected to the frame by means of pivot 235. The range pointer is positioned adjacent the scale 214 with the scale being located forward of the pointer so the operator can view the position of the pointer with respect to the scale to read the desired range.

In the operation of the range scale, movement of the vertical compensating link is transmitted through the range pointer arm link and range pointer arm to the range pointer which indicates the range on the scale. The scale is calibrated by the user after running tests with his bow is which a range achieved for a particular setting of the sight is then marked on the scale. That is, the range numbers are marked on the scale after the position of the pointer in relation to the scale has been determined at a tested distance.

Figure 3A:
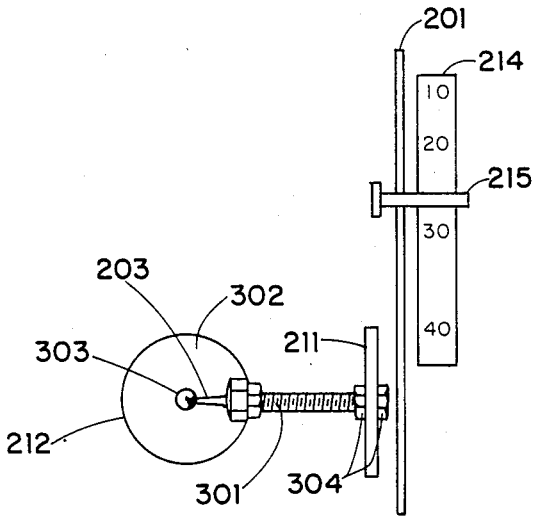
FIG. 3A is a rear elevation of the present invention illustrating the rear aperture's sight and the range gage.

FIG. 3A shows a view from the rear of the sight as seen by a right-handed operator during normal operation of the bow. The sighting elements are shifted to the right of frame 201 for a left-handed operator. The rear sighting element 212 is shown enclosing the forward sighting element 203.

Note that the forward sighting element is a screw 203 which is narrowed in the region designated by drawing numeral 302 to prevent blocking the target and thereby enhance the ability of the operator to accurately locate and aim at a selected target. At the end of the narrowed region is a ball 303 used to center the forward sighting element on the target.

The rear sight element 212 is a ring aperture sight which aids acquisition. Rear sight element 212 is connected to the rear sight mounting arm by means of a screw 301, and nuts 304 positioned about the aperture mounting arm which enables element 212 to be adjusted in the horizontal direction to correct for windage.

Forward sighting element 203 also is a screw which in combination with nuts 305 (FIG. 3B) about the forward sight crank 202, enables the forward sighting element to be adjusted in the horizontal direction to correct for windage.

FIG. 3A also provides the view the operator has of the range pointer 215 and scale 214. The numerals to which the pointer is aligned on the scale represents the range to which the sight is set.

Figure 3B:
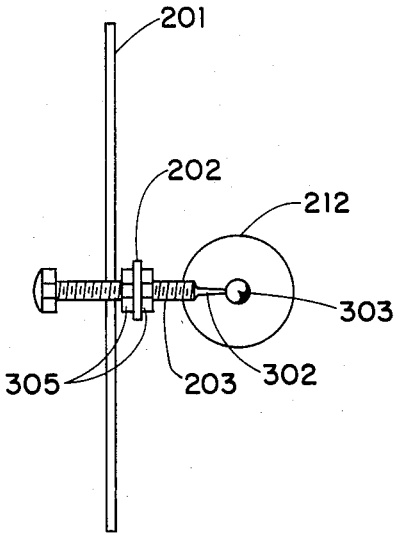
FIG. 3B is a front elevation of the present invention, illustrating the forward sighting pin.

FIG. 3B illustrates the view of the sight from a position forward of the sight. The forward sighting element 203 and the rear sighting element 212 can be clearly seen.

The sight is attached to the central portion of the bow at a level at which the operator can see (from his normal eye position) the ball portion of the forward sighting pin centered in the rear sight. The position of the sight can be varied for individual eye position preference. Once installed and calibrated the operator merely set the estimated range by means of the range adjustment ring and then sights the target through the rear and forward sighting elements. The desired target ranges, which is set by the movement of one of the rings is visible to the operator on the range scale. The range adjustment trigger and rings are positioned at a point where any finger on the hand holding the bow stock may conveniently grip one of the rings while the bow is in use.

The operator's stance and viewing position need never be changed regardless of the range to which the sight is set. Both the rear and forward sighting elements move simultaneously and are caused to remain aligned along any selected sight line from a plurality of sight line, which all emanate from the operator's desired eye position.

Although a specific embodiment has been described for purposes of illustration, there are a number of equivalents which remain within the scope of the invention. The distance the front and rear sighting elements are apart from one another may be varied as much as an undrawn arrow would protrude from the front of the bow. Any such variation in this distance is considered a minor design change within the scope of the invention.

The levers used in positioning the sight have been generally placed in the vertical reference plane to facilitate the description of the invention; however, it would be possible for one skilled in the art after reviewing this description to employ equivalent devices in which similar levers are oriented in different plane or in which gears or other equivalent linking elements are substituted for the levers to obtain the same movement of the forward and rear sight. Such variations or design substitutions are considered equivalents within the spirit and scope of the claimed invention.

Having described my invention, I claim:

1. A sight for archery bow of the type used to propel an arrow and which is actuated by an operator who is positioned rearward of the bow, the bow having a central region about which the arrow passes and which includes a grip used by the operator as a means for holding the bow, the bow being considered for reference purposes as positioned generally vertically and an arrow on the bow being positioned generally horizontally, the bow and arrow in these positions defining a vertical reference plane, while the direction of the arrow as indicated by the location of the arrow tip with respect to the bow when the arow is placed in its conventional position across the bow in preparation for propelling the arrow from the bow defining a forward direction, with the opposite direction from the forward direction being defined as the rearward direction, said sight comprising:

(a) a frame positioned generally in the vertical reference plane and secured to the bow about the bow's central region, (b) a forward sighting element movably mounted to the frame, the forward sighting element being positioned generally orthogonal to the vertical reference plane, and its movement is generally in a vertical plane orthogonal to the vertical reference plane, (c) a rear sighting element movably mounted to the frame, the rear sighting element being positioned generally orthogonal to the vertical reference plane and its movement is in a plane generally orthogonal to the vertical reference plane, the rear sighting element being positioned closer to the operator's eye than the forward sighting element, and (d) means for simultaneously positioning the forward and rear sighting elements along any one of a plurality of sighting lines generally in the vertical reference plane, each sighting line originating at the operator's sighting eye and making a different angle with the horizontal to enable the operator to maintain his sighting eye at one position while aiming the bow at a target located at any one of a plurality of ranges, each range corresponding to one of said sighting lines, and said sight further comprising a range indicating means linked to said forward and rear sighting elements to indicate a range corresponding to a particular sighting line to which the forward and rear sighting elements are aligned, said sight still further comprising a range adjustment means linked to said sighting elements to provide a means by which the operator may move said range adjustment means and align the forward and rear sighting elements along any selected one of said sight lines, and wherein said means for positioning said forward and rear sighting elements comprises: a drive linkage, a forward sighting element crank comprising a first lever arm, a rear sighting element crank comprising a second lever arm, and a first and second pivot, the lever arms having two ends and being positioned in and constrained to more generally in the vertical plane, the first lever arm being connected at one end to the forward sighting element and at the other end to the drive linkage, the first pivot rotatably connecting the first lever to the frame at a point between its ends, the second lever arm being connected at one end to the rear sighting element and at the other to the drive linkage, and the second pivot rotatably connecting the second lever arm to the frame at a point between its ends, the distance from the forward sighting element to the first pivot divided by the distance from the first pivot to the connection of the drive linkage to the first lever arm being greater than the distance from the rear sighting element to the second pivot divided by the distance from the second pivot to the connection of the drive linkage to the second lever arm to provide for movement of the forward sighting element which is greater than that of the rear sighting element for the same movement of the drive linkage, enabling the forward and rear sighting elements to be aligned along any one of said plurality of lines.

2. A sight as claimed in claim 1, wherein said drive linkage comprises:

(a) a vertical compensating link positioned generally in the vertical reference plane, (b) means for connecting the first lever arm to a first point on the vertical compensating link, (c) means for connecting the second lever arm to a second point on the vertical compensating link, and (d) means for moving said vertical compensating link in a generally vertical direction to align the first and second sighting elements along any selected one of said plurality of sighting lines.

3. A sight as claimed in claim 2, wherein said means for connecting said first lever arm to said vertical compensating link comprises a forward compound lever positioned generally in the vertical reference plane, and a third and a fourth pivot, the forward compound lever having two ends and being connected at one end to one end of the first lever arm by means of the third pivot while the opposite end of the forward compound lever is rotatably connected to the vertical compensating link by means of the fourth pivot, the end of the first lever arm to which the forward compound lever is connected being located opposite the end connected to the forward sighting element.

4. A sight as claimed in claim 3, wherein said means for connecting the second lever arm to the vertical compensating link comprises a rear compound lever positioned generally in the vertical reference plane, a fifth and a sixth pivot, the rear compound lever having two ends and being rotatably connected at one end to the second lever arm by means of the fifth pivot, while the opposite end of the compound lever is rotatably connected to the vertical compensating link by means of the sixth pivot, the end of the second lever arm to which the rear compound lever is connected being located opposite the end connected to the rear sighting element.

5. Apparatus as claimed in claim 4, wherein the forward and rear compound levers are connected to the vertical compensating link at the same location and the forth and sixth pivots comprise only a single pivot.

6. A sight as claimed in claim 5, wherein said vertical compensating link is positioned generally vertically in the vertical reference plane and is constrained to move in a generally vertical direction, and wherein said sight further comprises a first and a second idler arm, a seventh, eighth, ninth and tenth pivot, the idler arms each having two ends and being positioned generally in the vertical reference plane and orthogonal to the vertical compensating link with the first arm located forward of, and the second rearward of the vertical compensating link and with the first arm positioned above the second, the first and second idler arms being rotatably connected to the frame by the seventh and eighth pivots respectively at their ends away from the vertical compensating link and rotatably connected to the vertical compensating link at their opposite ends by pivots nine and ten respectively, the connections and position of the first and second idler arms insuring the generally vertical motion of the vertical compensating link.

7. A sight as claimed in claim 6, wherein said idler arm is a bell crank, said bell crank having a vertex and said vertex being located adjacent the eight pivot, said bell crank further comprising an extension projecting generally verically above the eight pivot.

8. A sight as claimed in claim 7, wherein the forward sighting element is a pin positioned horizontally and connected to the end of the forward sighting element crank opposite the crank's connection to the forward compound lever, the movement of the forward sighting element being generally in a vertical plane oriented orthogonally to the vertical reference plane and said sighting elements further comprising means for adjustment in a direction orthogonal to the reference plane to correct for windage.

9. A sight as claimed in claim 8, wherein the rear sighting element is an aperture sight formed of an annular ring and wherein said sight further comprises a rear aperture sighting element support pin, rear sighting element mounting arm, a rear sighting element idler arm, and eleventh, twelfth and thirteenth pivots, the rear sighting element mounted arm and idler arm being positioned generally in the vertical reference plane, while the rear sighting element support pin and the rear sighting element are positioned in a vertical plane orthogonal to the vertical reference plane, the rear sighting element idler arm being generally located directly below the rear sighting element crank at a distance substantially equal to the length of the rear sighting element support pin, the rear sighting element idler arm having two ends and being rotatably connected at one end to the frame by means of pivot eleven, the rear sighting element mounting arm having two ends and being rotatably connected at each end to the remaining ends of the rear sighting element crank and idler arm respectively by means of pivots twelve and thirteen, respectively, the rear sighting element support pin having two ends and being movably attached to the rear sighting element mounting arm and rigidly attached at the other end to the rear sighting element, the rear sighting element support pin being positioned generally horizontal, and the movable attachment being adjustable for moving the rear sighting element in a horizontal direction orthogonal to the reference plane for windage correction, the rear sighting element idler arm maintaining the rear sighting element mounting arm and the rear sighting element generally vertically throughout their range of movement.

10. A sight as claimed in claim 7, further comprising a range pointer, a range pointer arm, a range pointer arm link, a range scale, and pivots fourteen, fifteen and sixteen, the range pointer arm being generally positioned and constrained to move in the vertical reference plane, while the range pointer and range pointer scale generally lie in vertical planes orthogonal to the vertical reference plane, the range pointer arm having two ends and being rotatably connected at one end to one end of the range pointer arm link by pivot fourteen, while the range pointer is rigidly connected to the opposite end of the range pointer arm, the range pointer arm being rotatably connected to the frame by means of pivot fifteen which is positioned on the arm at a point between its ends, the range pointer arm link having two ends and being positioned generally vertically, the upper end being connected to the range pointer arm and the lower end being connected by means of pivot sixteen to the vertical compensating link, the range scale being positioned adjacent the range pointer and the scale being secured to the frame on the side of the range pointer away from the operator's eye to permit viewing by the operator of the position of the range pointer with respect to the scale, the position of the vertical compensating link, which reflects the alignment of the sighting elements along a particular sight line, being transmitted through the range pointer arm link and the range pointer arm, to the range pointer for convenient reading by the operator.

11. A sight as claimed in claim 7, further comprising a range adjustment arm, a range adjustment trigger, and a seventeenth, eighteenth and nineteenth pivot, the range adjustment arm and the range adjustment trigger each having two ends and both being generally located in and constrained to move the vertical reference plane, the range adjustment arm positioned substantially horizontally while the range adjustment trigger is positioned substantially vertically, the two being connected at the forward end of the range adjustment arm by means of pivot seventeen and near the upper end of the range adjustment trigger, the upper end of the range adjustment trigger being rotatably mounted to the frame by means of pivot eighteen, the opposite end of the range adjustment arm being rotatably connected to the extension of the bell crank by means of pivot nineteen, movement of the range adjustment trigger being transmitted through the range adjustment arm and the bell crank to the vertical compensating link which in turn adjusts the position of the rear and forward sighting elements to a particular sight line corresponding to a particular range.

* * * * *